United States Patent [19]

Lenz

[11] 4,378,960

[45] Apr. 5, 1983

[54] VARIABLE GEOMETRY TURBINE INLET NOZZLE

[75] Inventor: Herman N. Lenz, Lambertville, Mich.

[73] Assignee: Teledyne Industries, Inc., Los Angeles, Calif.

[21] Appl. No.: 149,432

[22] Filed: May 13, 1980

[51] Int. Cl.[3] ..... F01D 5/14

[52] U.S. Cl. ..... 415/115; 415/164

[58] Field of Search ..... 415/165, 164, 163, 115, 415/116

[56] References Cited

U.S. PATENT DOCUMENTS

| | | | |
|---|---|---|---|
| 2,904,307 | 9/1959 | Balje et al. | 415/164 |
| 3,101,926 | 8/1963 | Weber | 415/164 |
| 3,489,339 | 1/1970 | Greenwald | 415/163 |
| 3,495,921 | 2/1970 | Swearingen | 415/163 |
| 3,639,075 | 2/1972 | Erwin et al. | 415/163 |
| 3,816,021 | 6/1974 | Lewis et al. | 415/163 |
| 3,990,809 | 11/1976 | Young et al. | 415/163 |
| 4,169,692 | 10/1979 | McDonough et al. | 415/115 |
| 4,179,247 | 12/1979 | Osborn | 415/163 |
| 4,193,738 | 3/1980 | Landis, Jr. et al. | 415/115 |

FOREIGN PATENT DOCUMENTS

| | | | |
|---|---|---|---|
| 628697 | 9/1949 | United Kingdom | 415/164 |
| 1119774 | 7/1968 | United Kingdom | 415/116 |

*Primary Examiner*—Louis J. Casaregola
*Assistant Examiner*—Jeffrey A. Simenauer
*Attorney, Agent, or Firm*—Gifford, VanOphem, Sheridan & Sprinkle

[57] ABSTRACT

A variable turbine inlet nozzle assembly is provided for use in high temperature environments. The nozzle assembly comprises a plurality of vanes and each vane includes a shaft extending outwardly from it. The shafts in turn are rotatably mounted to an annular mounting member so that the vanes are circumferentially spaced from each other and positioned within a gas stream passageway formed within the turbine housing between the combuster and turbine stages. An actuating assembly includes a ring rotatably mounted to the turbine housing concentrically with the mounting member while actuating arms extending between the ring and each shaft selectively rotates or pivots the vanes in unison with each other. Each vane further includes a hollow interior which is fluidly connected with the turbine engine compressor output to provide cooling to and prevent thermal distortion of the vanes.

7 Claims, 5 Drawing Figures

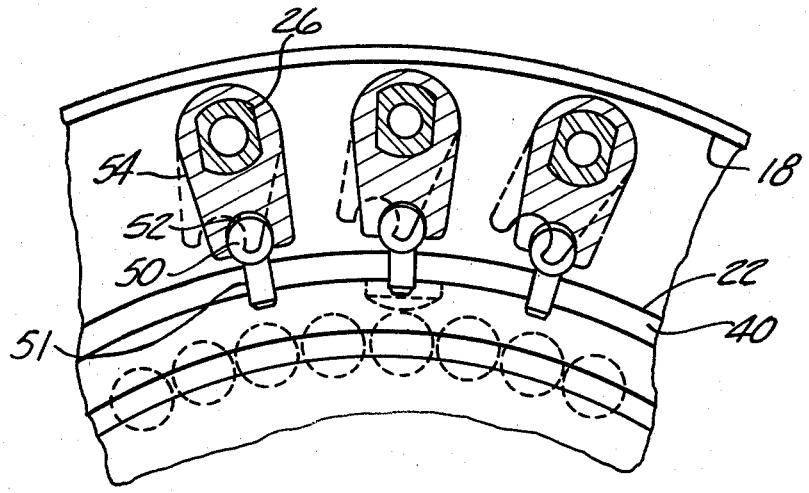
Fig-2
Fig-3
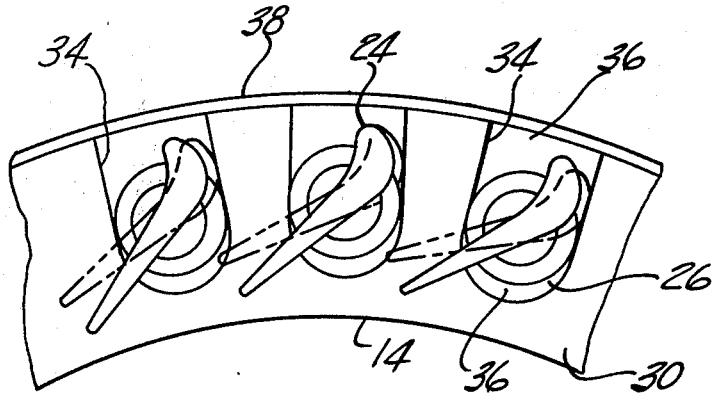

VARIABLE GEOMETRY TURBINE INLET NOZZLE

BACKGROUND OF THE INVENTION

I. Field of the Invention

The present invention relates generally to variable geometry turbine inlet nozzle assemblies and, more particularly, to such a nozzle assembly with cooling means.

II. Description of the Prior Art

In the conventional design of turbine engines, a turbine inlet nozzle assembly is provided within the gas stream passageway between the turbine engine combuster and the first turbine expander stage. The turbine inlet nozzle typically includes a plurality of circumferentially spaced vanes positioned within the gas stream passageway. In many of the previously known turbine engines, the nozzle vanes are fixed to the engine housing and, thus, are nonadjustable.

It is desirable, however, to variably adjust the throat area of the turbine inlet passageway for different power requirements of the turbine engine for maximum engine efficiency. One previously recognized method of variably restricting the throat area of the turbine inlet is to provide a turbine inlet nozzle with variable geometry, i.e., a turbine inlet nozzle in which the nozzle vanes are pivotally, rather than fixedly, mounted to the turbine engine housing. The previously known variable geometry inlet nozzle assemblies have also included some means to pivot or rotate the nozzle vanes in unison with each other.

The previously known variable geometry nozzle assemblies, however, have not proven entirely satisfactory for a number of different reasons. One disadvantage of the previously known variable geometry nozzle assemblies is that the means for pivoting the nozzle vanes have been incapable of pivoting all of the nozzle vanes in precise unison with each other. Such failure is due primarily to mechanical play in the actuating assembly. The inability to accurately pivot the nozzle vanes in unison with each other results in undesirable turbulences of the gas stream flow through the inlet nozzle and likewise degrades the overall efficiency of the turbine engine.

A still further disadvantage of the previously known variable geometry turbine inlet nozzles is that such nozzles are subjected to the high temperatures of the gas stream flow through the nozzle. As the temperature of the nozzle vanes become elevated, the vanes thermally distort the nozzle vane geometry and likewise degrade the overall efficiency of the turbine engine. Moreover, the vanes of the previously known variable geometry tubine nozzles have been rotatably mounted to the turbine support housing. Thus, thermal distortion of the support housing due to the high temperatures present within the nozzle gas stream also distort the geometry of the nozzle assembly.

SUMMARY OF THE PRESENT INVENTION

The present invention provides a variable geometry turbine inlet nozzle in which the nozzle vanes can be accurately pivoted in unison and with each other and in which the nozzle assembly can be operated in a high temperature environment without distortion to the nozzle vane geometry.

The nozzle assembly of the present invention is provided for use in conjunction with a turbine engine having a support housing, a combustor assembly, one or more turbine stages and a gas stream passageway which connects the outlet of the combustor assembly to the inlet of the turbine stage or stages. The nozzle assembly itself comprises a plurality of vanes and each vane is secured to a shaft which extends laterally outwardly from it. The shafts in turn are rotatably mounted within an annular mounting means so that the vanes are circumferentially spaced from each other and are also positioned within the gas stream passageway. Moreover, each shaft is positioned through a U-shaped groove in the annular mounting member so that openings are formed between the shaft and the mounting member and these openings are open to the gas stream passageway.

An actuating assembly is provided for rotating or pivoting the vane shafts in unison with each other. The actuating assembly further comprises an indexing ring which is rotatably mounted to the turbine engine support housing concentrically with the annular mounting member. A plurality of circumferentially spaced balls are secured to the indexing ring so that one ball is provided for each of the nozzle vanes. An actuating arm in turn is secured to and extends radially outwardly from each shaft and each actuating arm includes a U-shaped recess in which one ball of the indexing ring is positioned. Consequently, rotation of the ring simultaneously rotates all of the shafts and their attached vanes in unison with each other.

Each of the nozzle vanes includes a hollow interior which is open via a port in the trailing end of the vane to the gas stream passageway. In addition, a throughbore is provided through the shaft which is open at one end to the hollow vane interior and, at its other end, to the relatively cool compressed air from the turbine compressor outlet. Consequently, during the operation of the turbine engine, a portion of the compressed air from the compressor flows through the shafts and into the interior of the vanes thus cooling the vanes independently of the nozzle support housing. This cooling air flow is then expelled through the vane port and into the turbine engine gas stream. A portion of the compressed air from the turbine compressor is also expelled through the openings between the annular mounting member and the vane shaft thus cooling the mounting member and the vane shaft independently from the engine support housing. By thus cooling the variable nozzle assembly, the nozzle is maintained at lower temperature than the turbine engine gas stream through the nozzle thus minimizing thermal growth and distortion of the nozzle assembly.

BRIEF DESCRIPTION OF THE DRAWING

A better understanding of the present invention will be had upon reference to the following detailed description when read in conjunction with the accompanying drawing wherein like reference characters refer to like parts throughout the several views, and in which:

FIG. 2 is a fragmentary sectional view taken substantially along line 2—2 in FIG. 1;

FIG. 3 is a fragmentary sectional view taken substantially along line 3—3 in FIG. 1;

DETAILED DESCRIPTION OF A PREFERRED EMBODIMENT OF THE PRESENT INVENTION

Figure 1:
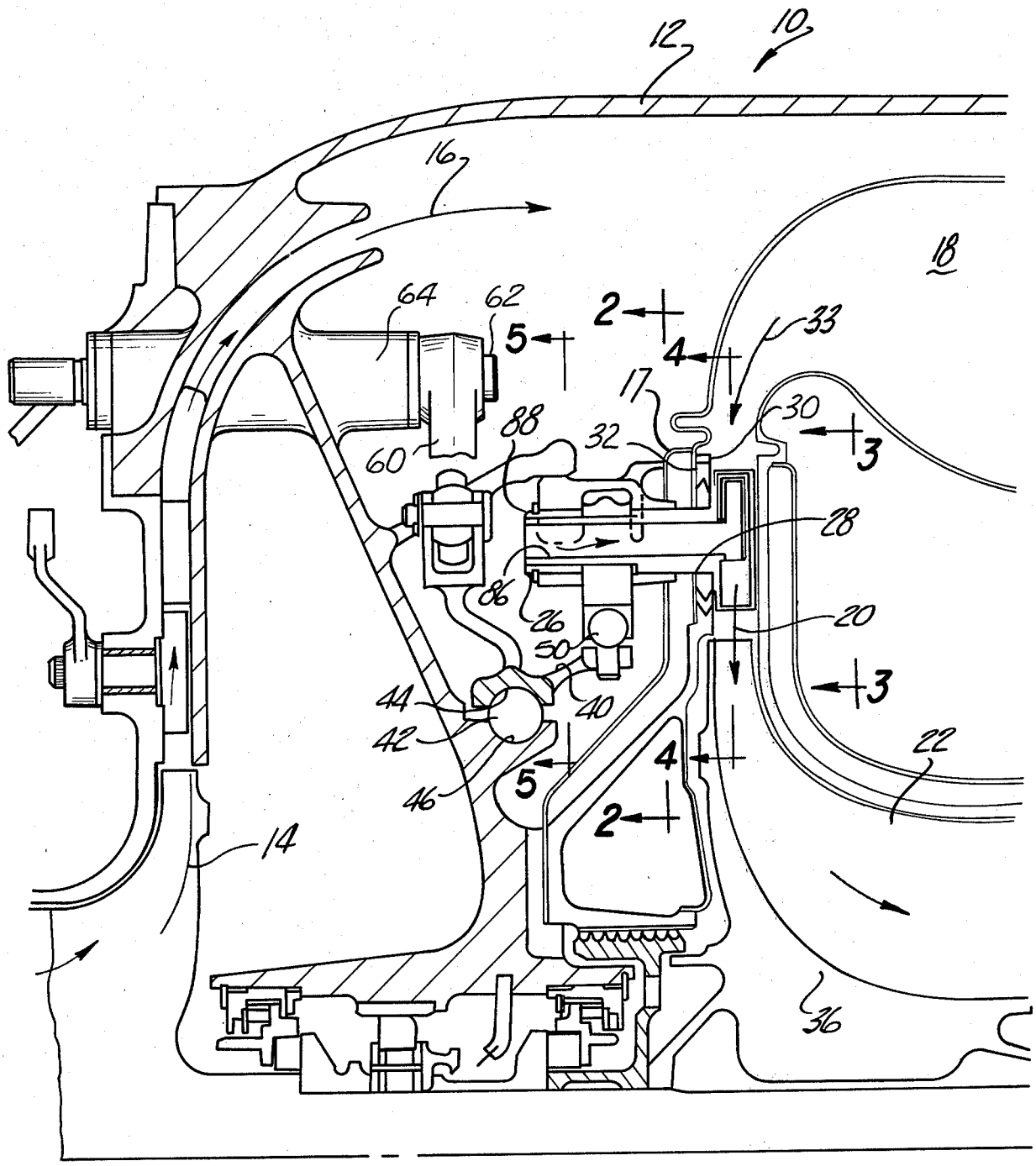
FIG. 1 is a fragmentary axial sectional view illustrating a variable turbine nozzle assembly according to the present invention.

With reference to FIG. 1, a portion of a turbine engine 10 is thereshown having a support housing 12. A final compressor stage 14 of a turbine compressor supplies compressed air, as indicated by arrow 16, to a combustion chamber 18. The combustion products resulting from combustion in the combustion chamber 18 pass through a nozzle gas stream passageway 20 and through one or more turbine stages 22 to rotatably drive the turbine stages 22 in the well known fashion. As shown in FIG. 1, the nozzle gas stream passageway 20 is generally annular in shape and the flow the gas stream from the combustion chamber 18 is generally radially inward.

Referring now to FIGS. 1 and 3, a preferred embodiment of variable geometry turbine nozzle assembly according to the present invention is thereshown and comprises a plurality of vanes 24 which are positioned within the nozzle passageway 20 and are circumferentially spaced from each other. Each vane 24 includes a shaft 26 extending laterally outwardly from it and through an opening 28 (FIG. 1) in the support housing 12. Thus, while the vanes 24 are positioned within the nozzle passageway 20, the shafts 26 are positioned exteriorly of it.

Still referring to FIGS. 1 and 3, an annular mounting member 30 is also positioned within the nozzle passageway 20 in between the vanes 24 and one wall 32 of the support housing 12 defining the nozzle passageway 20. A plurality of U-shaped openings 34 are formed through the mounting member 30 and one shaft 26 is rotatably positioned within each U-shaped opening 34 so that an aperture 36 is formed between each shaft 26 and the mounting member 30. The purpose of the aperture 36 will be subsequently described in greater detail. In addition, a retaining ring 38 is secured around one edge of the mounting member 30 at the open end of each U-shaped opening 34 to retain the vane shafts 26 to the mounting member 30.

Referring now to FIGS. 1 and 2, an indexing ring 40 is rotatably mounted to the support housing 12 by ball bearings 42 mounted concentrically with the annular mounting member 30. Preferably, one surface 44 of the indexing ring 40 forms an outer ball bearing race while an inner ball bearing race 46 is formed along the support housing 12. The ball bearings 42 are then positioned in between the races 44 and 46 so that the indexing ring 40 rotates with respect to the support housing 12.

Still referring to FIGS. 1 and 2, a plurality of circumferentially spaced spherical drive pins 50 are secured to the indexing ring 40 by any conventional means, such as press fitting a shank 51 on each pin 50 into the ring 40, so that the drive pins 50 extend radially outwardly from the indexing ring 40. As is best shown in FIG. 2, each spherical drive pin 50 is then positioned within a U-shaped recess 52 formed in an actuating arm 54. Each actuating arm 54, in turn, is secured to and extends radially outwardly from one of the vane shafts 26. Any conventional means can be used to secure the actuating arms 54 to the vane shaft 26 but, as shown in FIG. 2, the actuating arms 54 are keyed to the vane shafts 26.

Referring now to FIG. 2, rotation of the indexing ring 40 in a counterclockwise direction, i.e., from the position shown in solid line to the position shown in phantom line, simultaneously rotates the actuating arms 54 and thus the vanes 24 via the vane shaft 26 to the position shown in phantom line. Moreover, since the spherical drive pins 50 are snuggly positioned within their U-shaped recesses 52 in the respective actuating arms 54, virtually all mechanical play between the indexing ring and the vanes 24 is eliminated.

Figure 5:
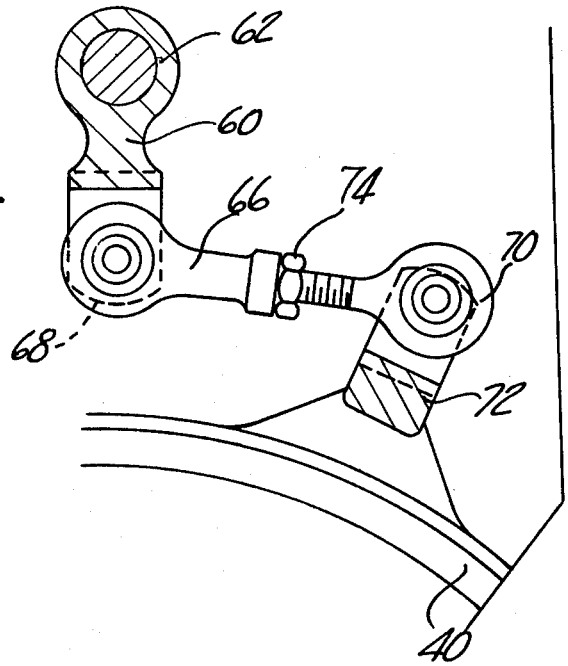
FIG. 5 is a sectional view taken substantially along line 5—5 in FIG. 1 and enlarged for clarity.

With reference now to FIGS. 1 and 5, although any means can be used to rotate the indexing ring 40 and thus rotate the vanes 24, as shown, a linkage arm 60 is secured at one end to a shaft 62 which is rotatably journaled in a boss 64 in the support housing 12. A second linkage arm 66 is rotatably secured at one end 68 to the opposite end of the first linkage arm 60 while the other end 70 of the second linkage arm 66 is pivotally connected to a radial extension 72 of the indexing ring 40. Adjustment means 74 are preferably provided on the arm 66 to preset the initial position of the indexing ring 40 with the shaft 62 in a predetermined position. Rotation of the arm 60 rotates the indexing ring 40 and thus rotates or pivots the vanes 24 in the previously described fashion.

Figure 4:
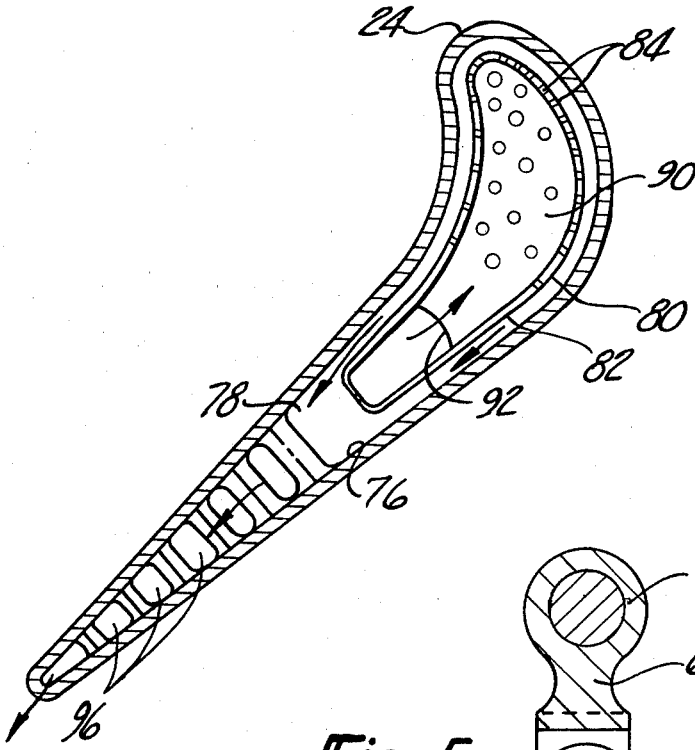
FIG. 4 is a fragmentary sectional view taken substantially along line 4—4 in FIG. 1 and enlarged for clarity.

Referring now to FIGS. 1 and 4, each nozzle vane 24 is of a thin walled construction thus having an interior wall 76 which defines an interior chamber 78 for each vane 24. A vane liner 80 is positioned within the interior chamber 78 of each vane 24 so that the outer periphery 82 of the liner is spaced inwardly from the inner wall 76 of the vane 24. A plurality of apertures 84 are formed through the liner 80 to permit fluid flow through the vane liner 80 and against the interior wall 76 of the vane 24.

Still referring to FIGS. 1 and 4, each vane shaft 26 includes a throughbore 86 which is open at one end 88 to the compressed air outlet 16 from the turbine compressor 14. The opposite end of the shaft throughbore 86 is open to the interior 90 of the vane liner 80 via an opening 92 (FIG. 4) in the vane liner 80.

In operation, the angle of the vanes 24 within the nozzle gas stream passageway 20 are adjusted, as desired, by rotation of the shaft 62 and the corresponding rotation of the indexing ring 40 in the previously described fashion.

Simultaneously, a portion of the compressed air 16 from the turbine enters into the interior of each vane liner 80 through the vane shaft throughbore 86 and liner opening 92. This compressed air then exits through the apertures 84 formed through the vane liner 80 and impinges upon the inner walls 76 of the vanes 24 thus cooling the vanes 24 in the desired fashion. This compressed air eventually is expelled from the interior 78 of the vanes 24 through one or more ports 96 (FIG. 4) formed through the trailing end of the vanes 24 and thus enters the gas stream for the turbine engine.

The size and/or density of the ports 84 formed through the vane liner 80 are arranged in accordance with the cooling requirements of the vanes 24 and thus minimize thermal gradients across the vanes 24. Thus, as best shown in FIG. 4, a plurality of ports 84 are formed adjacent the leading edge of the vane 24 where the vane cooling requirements are the greatest while fewer ports 84 are formed along the mid and trailing portions of the vane 24 where cooling requirements are less severe.

As is best shown in FIG. 3, a portion of the compressed air 16 from the turbine compressor 16 is also bled through the openings or apertures 36 formed between the vane shaft 26 and the annular mounting member 30. The compressed air flow through the openings 36 provides cooling to the annular mounting member 36 and insures that the entire variable geometry nozzle assembly is held stationary with respect to the compressor despite thermal growth of the support housing forming the nozzle gas stream passageway 20. Consequently, the variable geometry nozzle assembly of the present invention can be operated in the high temperature environment present in the nozzle gas stream passageway 20 without thermal distortion thus resulting in true vane geometry.

Having described my invention, however, many modifications thereto will become apparent to those skilled in the art to which it pertains without deviation from the spirit of the invention as defined by the scope of the appended claims.

I claim:

1. A nozzle assembly for a turbine engine, said engine comprising a housing and an annular gas stream passageway formed in the housing immediately upstream from one or more turbine stages, said nozzle assembly comprising:

a plurality of vanes, each vane being secured to a shaft, means for rotatably mounting said shafts to said engine housing so that said vanes are disposed in said gas stream passageway, means for rotating said shafts in unison with each other;

means for cooling said vanes, an annular mounting member secured to said housing, said mounting member having a plurality of circumferentially spaced apertures formed through it through which said shafts are rotatably mounted, and means for cooling said mounting member, wherein said mounting member apertures are greater in cross sectional area than said shafts thus forming an opening therebetween which is open at one end to said gas stream, and wherein said means for cooling said mounting member further comprises supplying a source of pressurized fluid to the other side of said openings.

2. The invention as defined in claim 1 wherein each vane includes a hollow interior, at least one port formed through each vane which establishes fluid communication between the interior of the vane and the gas stream, and wherein said cooling means further comprises means for fluidly communicating said source of pressurized fluid to the interior of each vane.

3. The invention as defined in claim 2 wherein said source of pressurized fluid comprises a source of compressed air and wherein said last mentioned means further comprises a fluid passageway formed through each shaft, one end of each fluid passageway being open to the interior of one vane and the other end of each passageway being open to said compressed air source.

4. The invention as defined in claim 2 and further comprising a liner positioned within the interior of each vane, said liner having an outer periphery spaced inwardly from the interior walls of the vane, said liner defining an interior chamber which is fluidly connected to the pressurized fluid, and wherein said liner includes a plurality of fluid ports formed through it.

5. The invention as defined in claim 1 wherein said means for rotating said shafts further comprises a ring and means for rotatably mounting said ring to the turbine engine housing, an actuator arm secured to and extending outwardly from each shaft, linkage means for mechanically connecting each actuator arm to said ring, and means for selectively rotating said ring.

6. The invention as defined in claim 5 wherein said linkage means further comprises a ball secured to said ring for each vane, each ball being received within a recess formed on each actuator arm.

7. The invention as defined in claim 5 wherein said means for rotatably mounting said ring to the housing further comprises an annular bearing race formed in the housing, a cooperating bearing race formed on the ring and a plurality of ball bearings positioned in between said bearing races.

* * * * *